US007210816B2

(12) United States Patent
Lin

(10) Patent No.: US 7,210,816 B2
(45) Date of Patent: May 1, 2007

(54) AUTOMATICALLY ROTATABLE LAMP BALL

(76) Inventor: Lisa Li-Hsiang Lin, 9F, 196, Chowtze St., Taipei (TW) 114

( * ) Notice: Subject to any disclaimer, the term of this patent is extended or adjusted under 35 U.S.C. 154(b) by 0 days.

(21) Appl. No.: 11/285,033

(22) Filed: Nov. 23, 2005

(65) Prior Publication Data

US 2007/0014099 A1 Jan. 18, 2007

(30) Foreign Application Priority Data

Jul. 14, 2005 (CN) ..... 2005 2 0113713

(51) Int. Cl.
*F21V 33/00* (2006.01)

(52) U.S. Cl. ..... 362/234; 362/35; 362/253; 362/800; 362/806; 446/242; 473/570 F

(58) Field of Classification Search ..... 362/35, 362/234, 253, 363, 386, 800, 806; 446/236, 446/242; 473/570
See application file for complete search history.

(56) References Cited

U.S. PATENT DOCUMENTS 4,146,919 A * 3/1979 Jennings ..... 362/35
5,084,803 A * 1/1992 Lan ..... 362/35
5,692,946 A * 12/1997 Ku ..... 473/570

* cited by examiner

*Primary Examiner*—Stephen F Husar
(74) *Attorney, Agent, or Firm*—Bacon & Thomas, PLLC

(57) ABSTRACT

An automatically rotatable lamp ball includes a power unit provided with a motor having its downward shaft driving two rollers to rotate and its upward shaft driving a lamp arm to rotate. The lamp arm is disposed thereon with a plurality of LEDs, and the integral body of the power unit and the lamp arm is received in the interior of a transparent outer casing and actuated to rotate therein for pushing the outer casing to roll freely at the same time. When the lamp arm is actuated to rotate, the LEDs installed thereon will simultaneously give out flickering lights in sequence and at intervals and, due to visual persistence, presenting freely movable stereoscopic light patterns or letters. So the invention is innovative and exclusively original in structure and having excellent entertaining effect.

15 Claims, 8 Drawing Sheets

AUTOMATICALLY ROTATABLE LAMP BALL

BACKGROUND OF THE INVENTION

1. Field of the Invention

This invention relates to an automatically rotatable lamp ball, particularly to one provided with rollers and a lamp arm able to be rotated and give out bright lights at the same time. After the lamp ball is placed in the interior of a transparent outer casing, the whole outer casing can be driven by the rollers to roll and move forward freely, and LEDs arranged on the lamp arm can be controlled by the IC programs inside the lamp ball to give out flickering lights in sequence and at intervals. By rotation of the lamp arm and due to visual persistence, the automatically rolling stereoscopic lights will be seen, offering viewers an exclusively original and surprising visual feeling.

2. Description of the Prior Art

Nowadays, there are various kinds of automatically rolling spherical toys, such as disclosed in a Taiwan patent No. 277343, titled "Improved Structure For Rolling Toys", and No. 294052, titled "Improved Structure For Rolling Toys (2)". In general, some spherical toys are provided with a power unit and able to roll automatically, but unable to actuate the radial arms appended thereon to rotate and give out bright lights synchronously, while other spherical toys are able to be rolled and give out flickering lights, such as shining yo-yos, but unable to roll automatically and provided with no radial arms to rotate synchronously for increasing entertaining effect. For the present, technology has been developed and toys have become more manifold than ever; therefore, toys must be exclusively original, interesting and diversiform; otherwise, they cannot appeal to consumers, especially children. For instance, if automatically rotatable toys can be additionally provided with a device for giving out and controlling flickering lights, they can surely attract consumers. For avoiding monotony and achieving entertaining effect, automatically rotatable spherical toys, which are provided with LEDs inside and able to give out flickering lights, had better be able to present brilliant and changeable light patterns when the lamp ball rotate.

SUMMARY OF THE INVENTION

The objective of the invention is to offer an automatically rotatable lamp ball including a power unit, a lamp arm and a transmission unit with a conducting unit. The power unit is composed of a front half unit and a rear half unit, having its interior installed with batteries, a motor and a switch member for controlling power conduction of the batteries. The motor is provided with a downward shaft for driving two rollers assembled at one side of the power unit to rotate after reducing speed. The power unit has the other side assembled with a no-power roller. The motor is further provided with an upward shaft for driving a gear with a center shaft hole to rotate after reducing speed. The lamp arm is composed of a front half arm shell and a rear half arm shell and divided into a center arm body positioned above the power unit and two side arm bodies respectively extending downward from the center arm body to two opposite sides. The center arm body of the lamp arm is formed with a center chamber in the interior for receiving a circuit board and bored with a hollow shaft groove extending downward. The two side arm bodies have their interiors respectively formed with a side chamber for installing therein with a plurality of LEDs that are electrically connected with the circuit board. The transmission unit is provided with a conductive center shaft having a part of its outer side fitted around with an insulating sleeve mounted around with a conducting shaft tube. The center shaft, the insulating sleeve and the conducting shaft tube together make up a rod-shaped conducting unit to be inserted through the center shaft hole of the gear of the power unit and firmly positioned in the hollow shaft groove under the center chamber of the lamp arm for supporting and driving the lamp arm to rotate and serving as a rotation axis of the lamp arm. The power unit is disposed with two conducting brush members respectively positioned in its front and rear half unit. One end of the two conducting brush members serves as one electrode of electricity and the other end respectively contacts with the conducting center shaft and the conducting shaft tube, which are electrically connected with the circuit board in the main chamber of the lamp arm. The integral body of the power unit and the lamp arm is placed in the interior of a transparent outer casing and actuated to rotate therein for pushing the outer casing to roll freely. Thus, changeable flickering lights given out by the LEDs on the lamp arm can be seen through the transparent outer casing and, by visual persistence, the stereoscopic light patterns or letters can be presented before viewers,

BRIEF DESCRIPTION OF DRAWINGS

This invention will be better understood by referring to the accompanying drawings, wherein.

DETAILED DESCRIPTION OF THE PREFERRED EMBODIMENT

Figure 1:
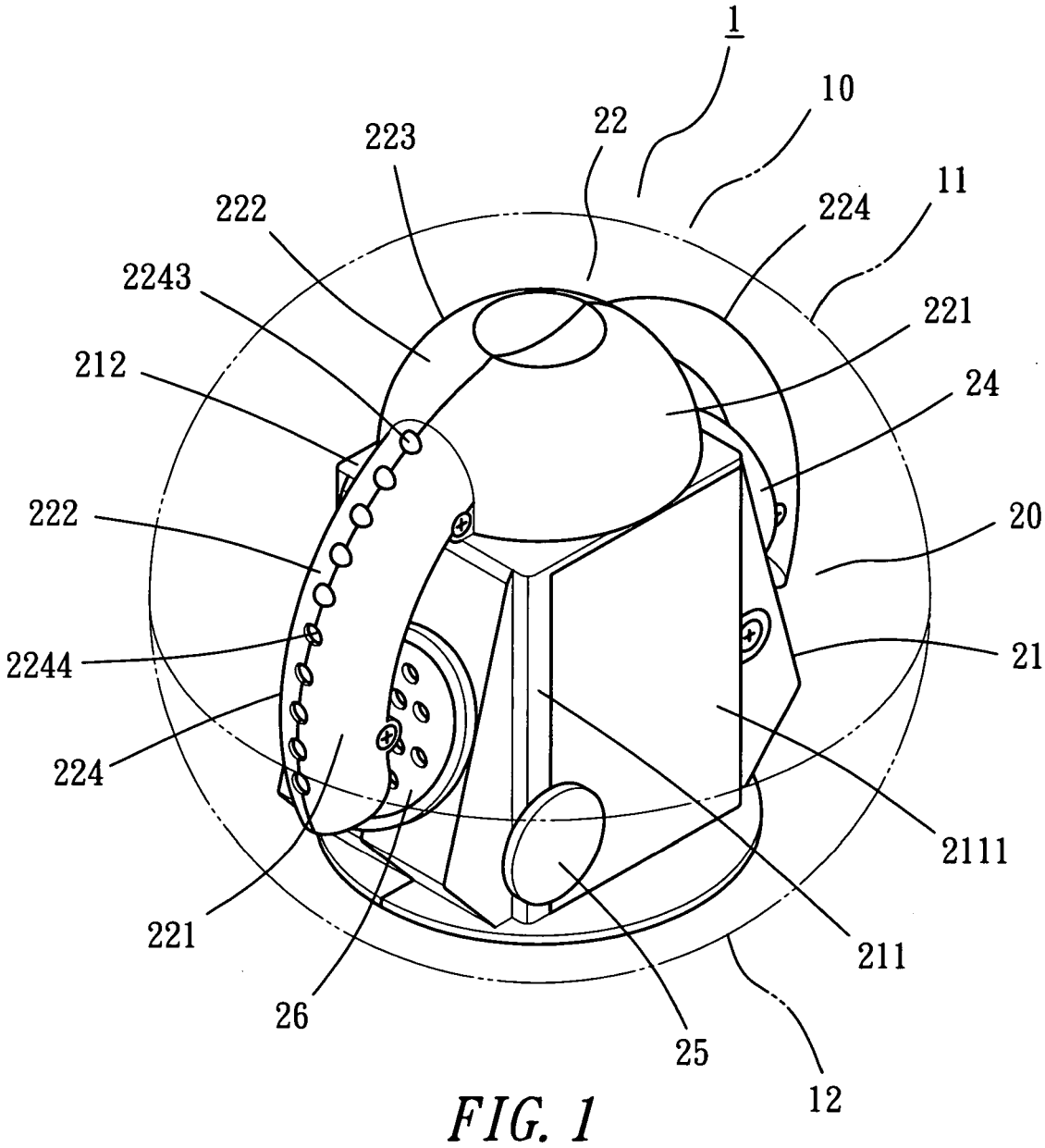
FIG. 1 is a front perspective view of an automatically rotatable lamp ball in the present invention.
Figure 2:
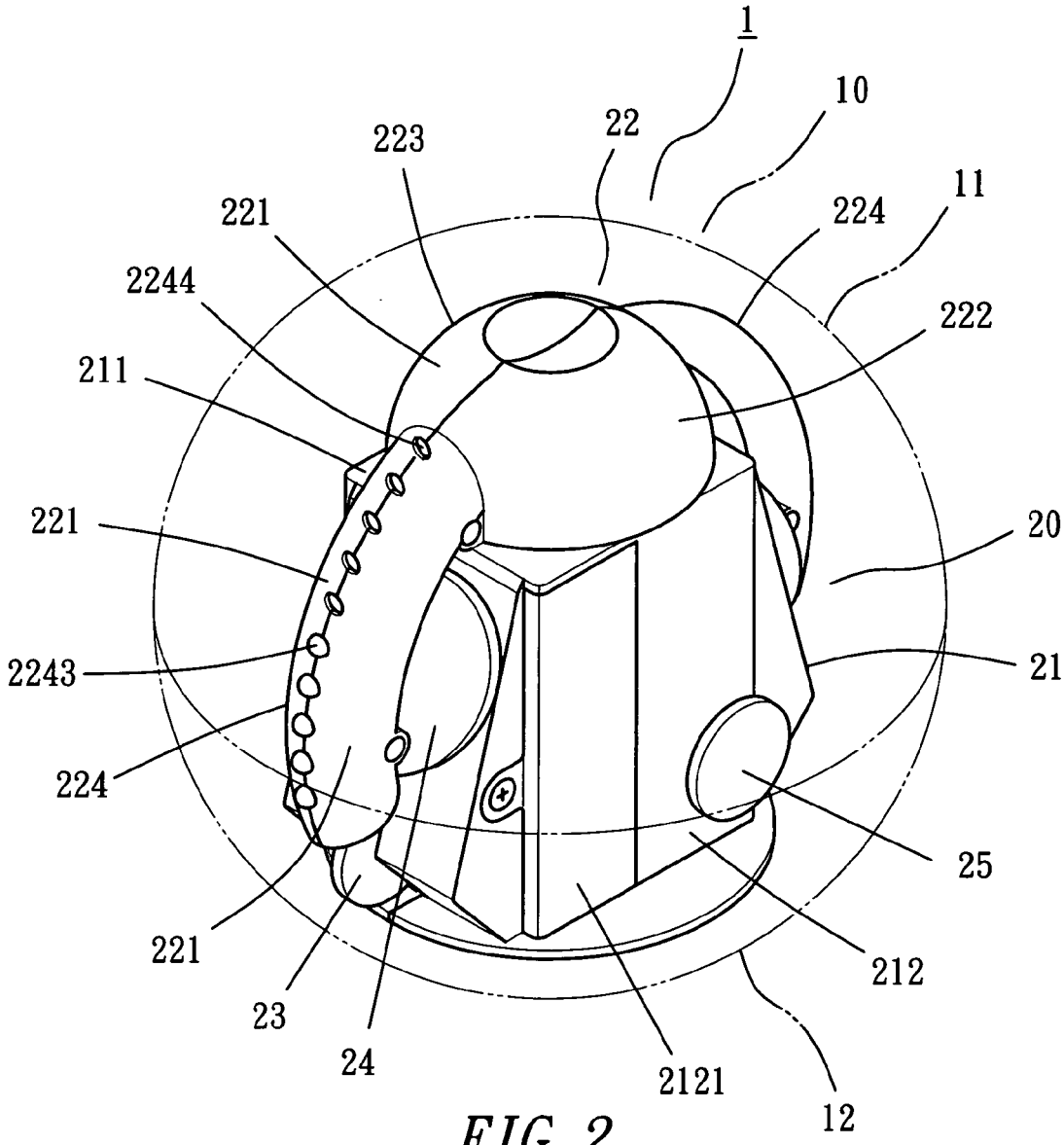
FIG. 2 is a rear perspective view of the automatically rotatable lamp ball in the present invention.

A preferred embodiment of an automatically rotatable lamp ball 1, as shown in FIGS. 1 and 2, includes a spherical outer casing 10 and a power-and-lamp arm unit 20.

Figure 3:
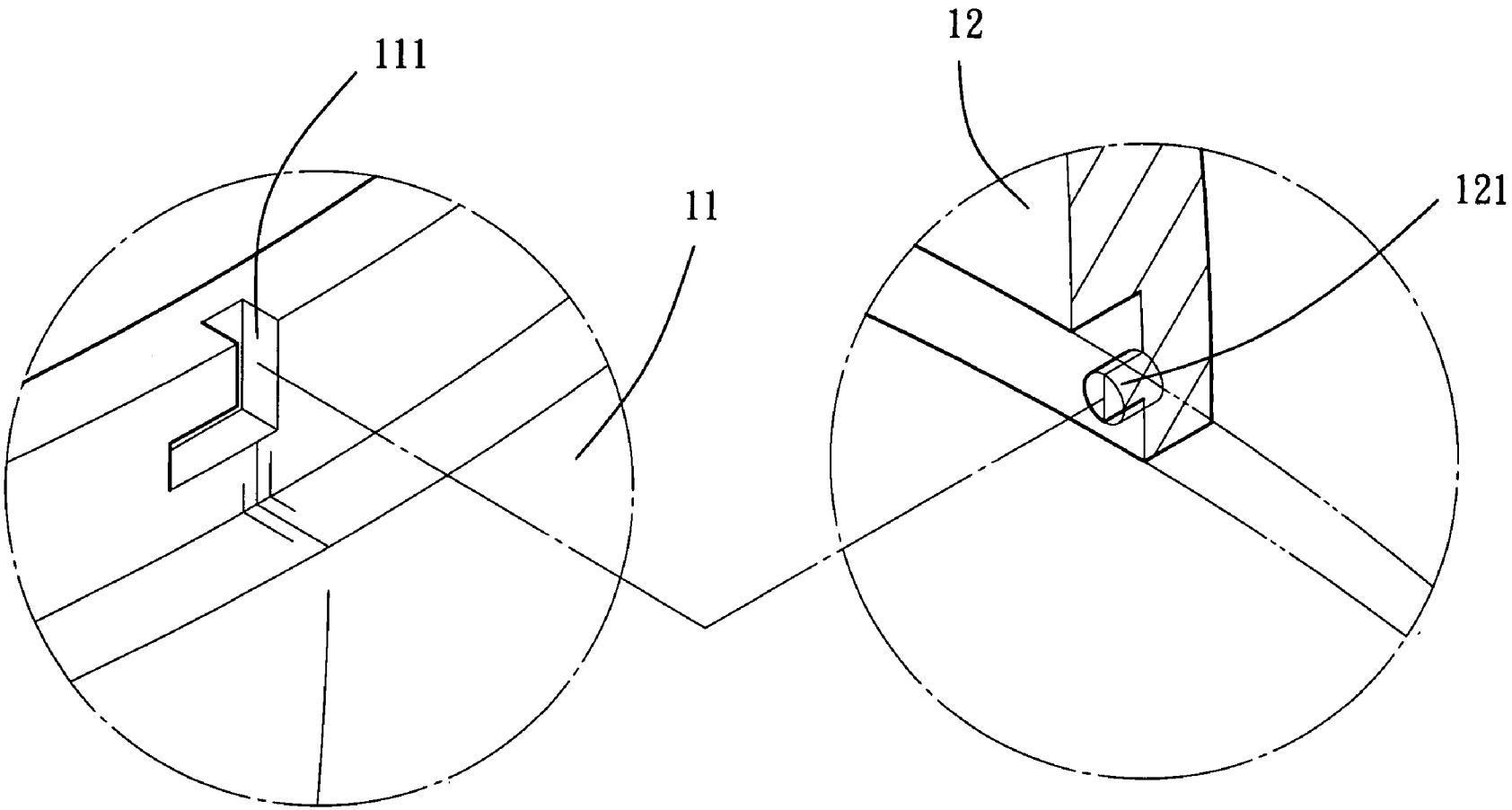
FIG. 3 is a partial exploded perspective view of two half casings of the lamp ball, respectively provided with engage members in the present invention.

The spherical outer casing 10 made of transparent material is composed of two half casings 11 and 12 respectively and correspondingly provided with plural L-shaped engage slots 111 and projecting members 121, as shown in FIG. 3. The mutually combining edges of the two half casings 11, 12 can be closely combined together by vertically engaging the projecting members 121 in the L-shaped engage slots 111 and then moving the projecting members 121 horizontally.

The two half casings 11, 12 can be disengaged from each other by operating steps reverse to those mentioned above. Apart from this way of mutual engagement of the engage slots 111 and the projecting members 121, the two half casings 11, 12 can also be combined together in another way of screwing or clasping. Alternate combinations of the two half casings having the same effect are within the scope of this invention.

The power-and-lamp arm unit 20 has a diameter within the range of a false spherical diameter that is a little smaller than the inner diameter of the spherical outer casing 10. In using, the power-and-lamp unit 20 is positioned in either of the two half casings 11 or 12 and then the two half casings 11, 12 are combined together to make up an integral spherical outer casing 10 with the power-and-lamp arm unit 20 in its interior.

Figure 4:
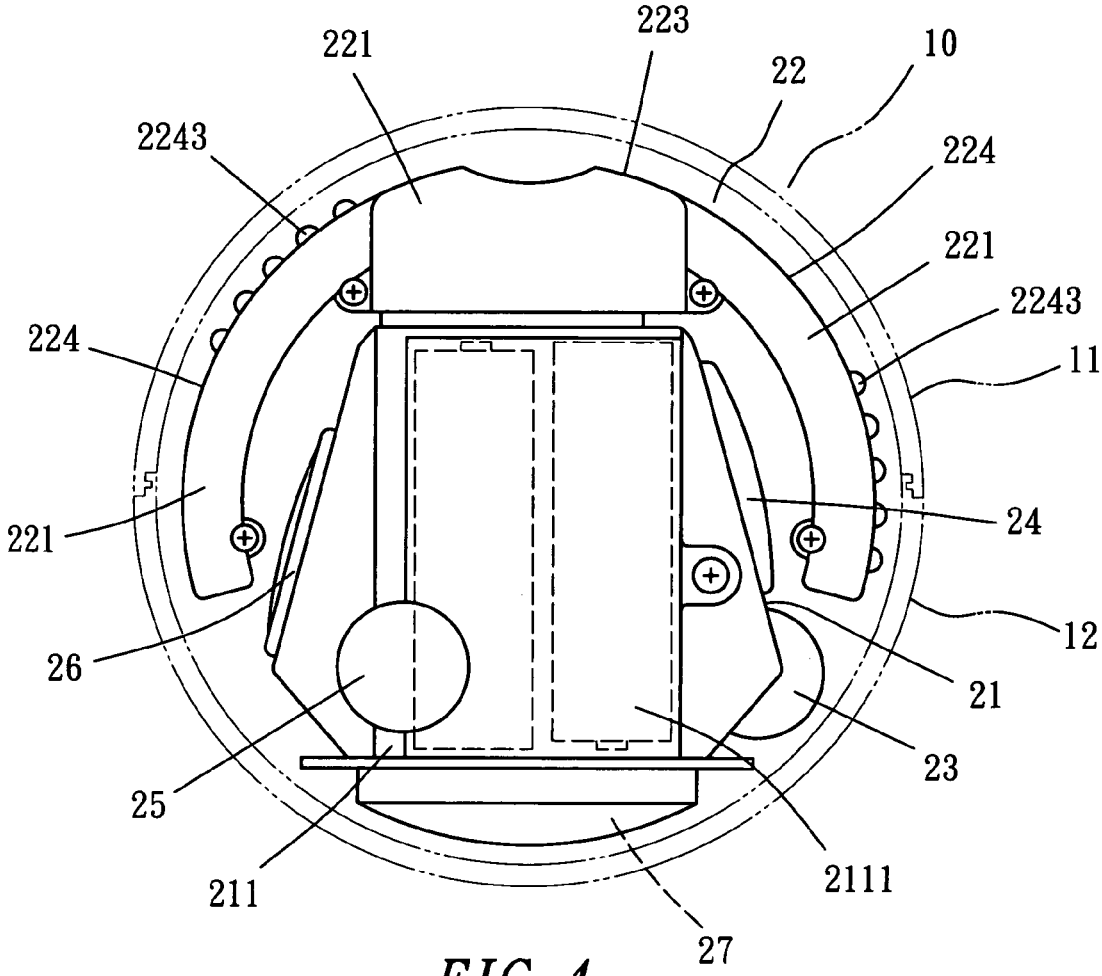
FIG. 4 is a front cross-sectional view of the automatically rotatable lamp ball in the present invention.

The power-and-lamp arm unit 20, as shown in FIGS. 1 and 2, includes a power unit 21 and a lamp arm 22. The power unit 21, as shown in FIG. 4, consists of a front and a rear half unit 211, 212. The front half unit 211 is provided with a cover 2111 covered on the front side, having its interior formed with a recessed space for receiving two batteries, as shown in FIG. 4. Further, the front half unit 211 has one side provided with a no-power roller 23 and a sound switch 24, which are positioned between the front and the rear half unit 211, 212, and the other side provided with a roller 25 positioned at the front side and a sounder 26 facing sideward for giving out music or sounds preset. The lamp arm 22 is composed of a front half arm shell 221 and a rear half-arm shell 222. The two half arm shells 221, 222 have their central portion formed with a circle center arm body 223 positioned above the power unit.21 and a side arm body 224 respectively extending arcuate and downward from the center arm body 223.

Figure 5:
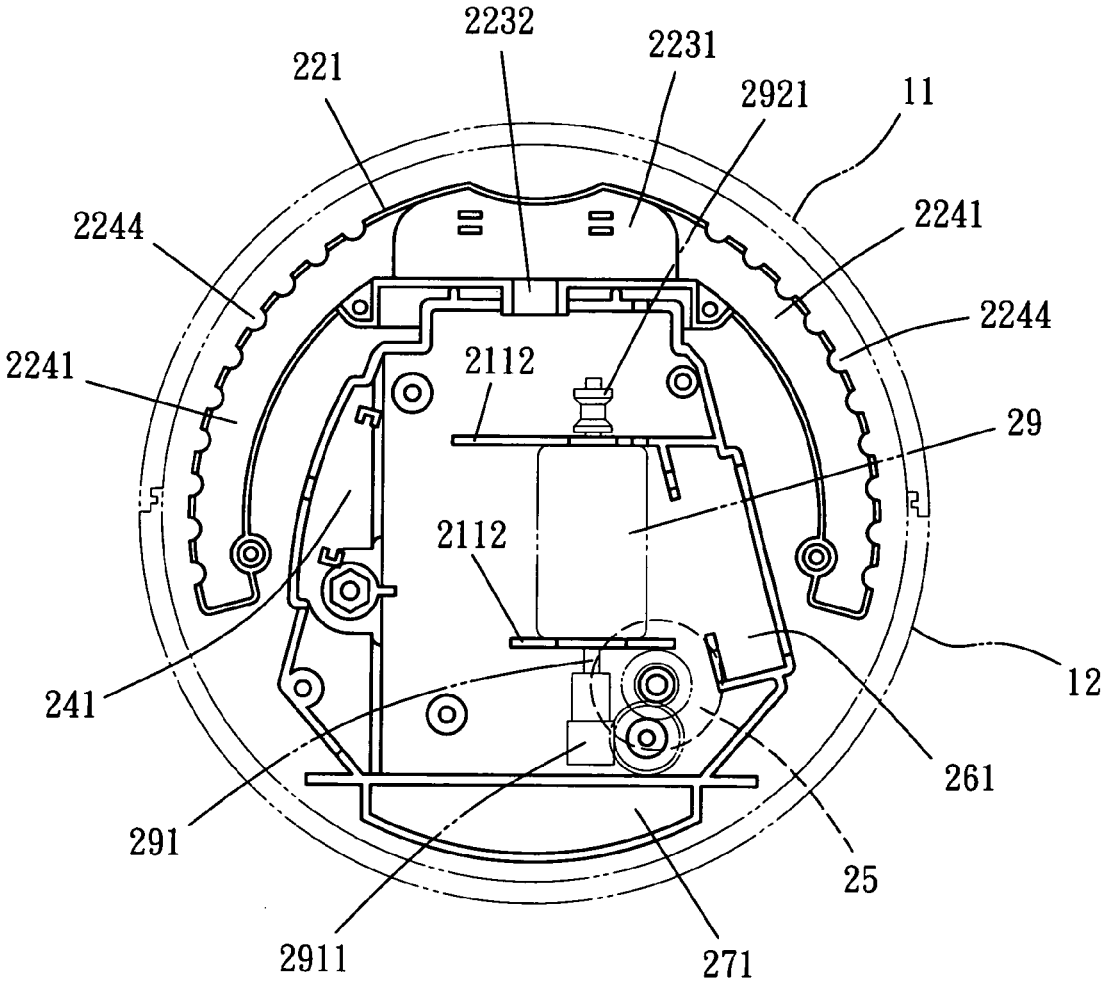
FIG. 5 is a rear cross-sectional view of the front half casing of the automatically rotatable lamp ball in the present invention.
Figure 6:
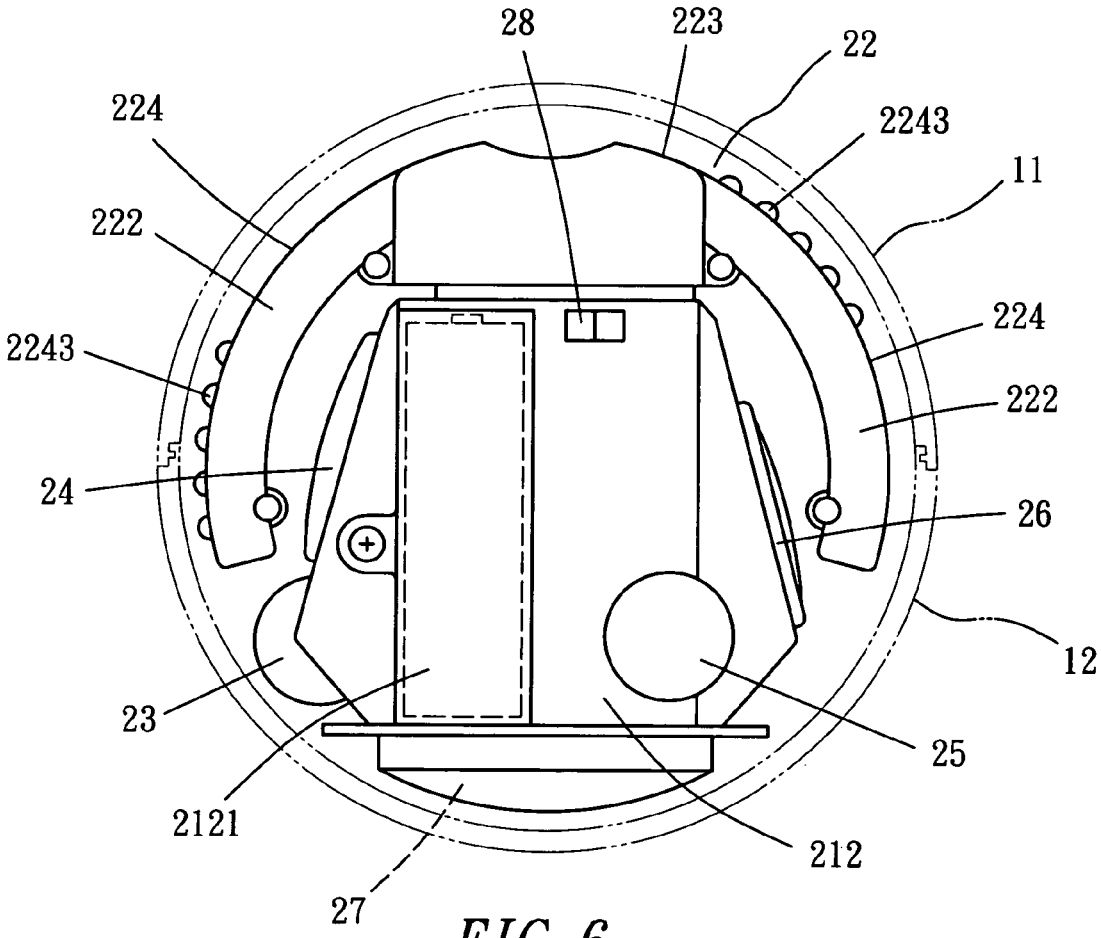
FIG. 6 is a rear cross-sectional view of the automatically rotatable lamp ball in the present invention.

The rear half unit 212 of the power unit 21, as shown in FIG. 6, has one side of its front covered with a cover 2121 and its interior formed with a recessed space for receiving a battery, which together with the two batteries in the front half unit 211 supplies the lamp ball with electricity. The rear half unit 212 has the other side of its front section provided with another roller 25, so there are two rollers 25 positioned at the front side of the two half units 211, 212. The rear half unit 212 of the power unit 21 further has its front side installed with a switch member 28. The front half unit 211 is bored with threaded holes for bolts to be respectively screwed therein to combine the front half unit 211 together with the rear half unit 212, and also formed with an accommodating groove 261 for receiving the sounder 26 and an accommodating groove 241 for installing the sound switch 24 therein and a balance weight chamber 271 for receiving a balance weight member 27 therein. Further, the front half unit 211 is disposed with two separating plates 2112 spaced apart to form a space therebetween. The space formed by the front and the rear half arm shell 221, 222 of the lamp arm 22 is divided into a center chamber 2231 in the center and two side chambers 2241 at the opposite sides, as shown in FIGS. 5 and 7.

Figure 7:
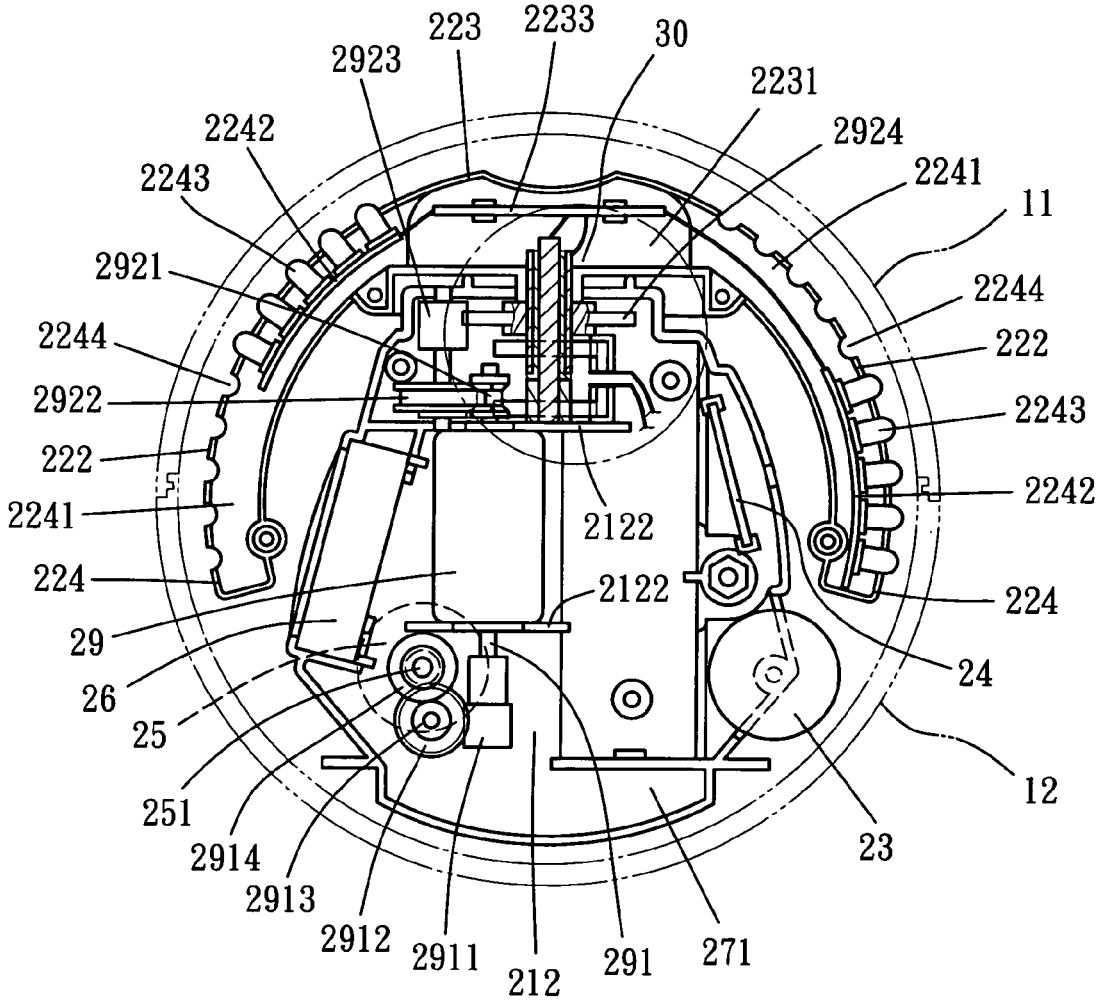
FIG. 7 is a cross-sectional view of the rear half casing with its inner components of the automatically rotatable lamp ball in the present invention.
Figure 8:
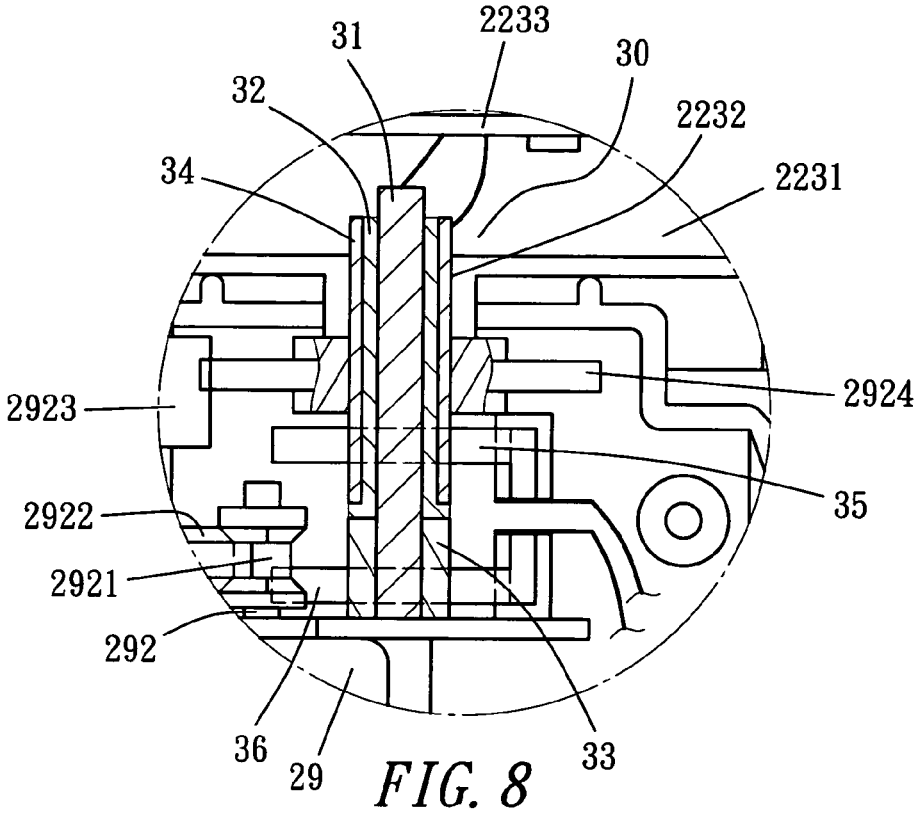
FIG. 8 is a magnified view of a partial structure in FIG. 7.

Referring to FIG. 7, which shows the rear half unit 212 of the power unit 21 and the rear half arm shell 222 of the lamp arm 22 as well as the components assembled therein, a space defined by the two separating plates 2122 at the rear side of the rear half unit 212 and the two separating plates 2112 of the front half unit 211 of the power unit 21 is formed for receiving a motor 39 therein. The motor 29 has its downward shaft 291 fitted thereon with a driving gear 2911 for driving another gear 2912 engaging the driving gear 2911. The gear 2912 is rotated to actuate a coaxial small gear 2913 to rotate synchronously and drive another gear 2914 to rotate. The gear 29,14 has the opposite end of its center shaft 251 respectively extending out of the front half unit 211 and the rear half unit 212 of the power unit 21 and respectively connected with the roller 25. Therefore, the two rollers 25 are respectively positioned at the outer side of the front and the rear half unit 211, 212, as shown in FIGS. 1 and 2, but the no-power roller 23 is clamped by the front and the rear half unit 211, 212 and positioned on their junction line. The motor 29, as shown in FIG. 8, has its upward shaft 292 fixed with a belt pulley 2921 for driving another belt pulley 2922 on another shaft so that the two pulleys 2911 and 2922 are driven by a belt to actuate a coaxial gear 2923 to rotate synchronously and drive a gear 2924 subsequently. The gear 2924, as shown in FIG. 8, is rotated to drive a transmission unit 30 to operate and actuate the lamp arm 22 located above to rotate, also to transmit the electricity supplied by the batteries to the lamp arm 22 for use.

The transmission unit 30, as shown in FIGS. 7 and 8, is disposed with a metal conducting center shaft 31 having a part of its upper outer side firmly fitted around with an insulating sleeve 32 and the rest outer side stably fitted around with a conducting bushing 33. The insulating sleeve 32 has its outer side fitted around with a conducting shaft tube 34 and its lower end formed with a disc-shaped bottom rim positioned between the conducting shaft tube 34 and the conducting bushing 33 to insulate the both 33, 34. The center shaft 31, the insulating sleeve 32, the conducting shaft tube 34 and the conducting bushing 33 together make up a rod-shaped conductive unit to be firmly inserted in the center shaft hole of the gear 2924. The lamp arm 22 is formed under its center arm body 223 with a hollow shaft groove 2232 defined by the lower walls of the front and the rear half arm shell 221, 222, or formed by the front half arm shell 221 or by the rear half arm shell 222 independently.

The rod-shaped conductive unit is inserted from under and firmly positioned in the hollow shaft groove 2232 by mutual engagement of the outer wall of the conducting shaft tube 34 and the inner wall of the hollow shaft groove 2232 for supporting the center arm body 223 of the lamp arm 22 and serving as a rotating axle of the lamp arm 22. Therefore, when the gear 2924 is rotated, it will actuate the rod-shaped conductive unit and the whole lamp arm 22 (including the center arm body 223 and the two side arm bodies.224) to rotate synchronously, that is, the transmission unit 30 transmits the power to the lamp arm 22 so that the lamp arm 22 can rotate.

In addition, the transmission unit 30 is provided with two conducting brush members 35, 36 respectively having one end fixed in position and connected with an electric wire that conducts the electricity of the batteries. The two conducting brush members 35, 36 have the other ends respectively contacting with the conducting shaft tube 34 and the conducting bushing 33. The conducting shaft tube 34 and the conducting bushing 33 could be respectively fitted thereon with a spring ring to let the conducting brush member 35, 36 closely contact with the spring ring for enhancing conductivity, thus the spring ring becoming a part of the conducting shaft tube 34 and the conducting busing 33. The conducting brush member 35, 36 with bending elasticity can respectively always contact with the conducting shaft tube 34 and the conducting bushing 33; therefore, the two conducting brush member 35, 36 can serve as two electrodes of electricity to the conducting shaft tube 34 and the conducting bushing 34. Simultaneously, the conducting shaft tube 33 will conduct electricity to the center shaft 31 and then the electricity is transmitted to a circuit board 2233 through the conducting shaft tube 34 and the center shaft 31, which can be connected with the circuit board 2233 by electric wires or connected directly with each other.

The circuit board 2233 is fixedly positioned in the center arm body 223 of the lamp arm 22. Since the center arm body 223 and the side arm bodies 224 are actuated to rotate by the center shaft 31 and the insulating sleeve 32 as well as the conducting shaft tube 34; therefore, the circuit board 2233 positioned in the center arm body 223 can be rotated synchronously and electricity can be transmitted to the circuit board 2233.

Further, the two opposite arm bodies 224 have their inner spaces respectively firmly installed with a circuit board 2242. The circuit board 2242 of one side arm body 224, as shown at the left side in FIG. 7, is provided at a comparatively high level, while the circuit 2242 of the other side arm body 224, as shown at the right side in FIG. 7, is provided at a comparatively low level. The two circuit boards 2242 are electrically connected with the circuit board 2233 by electric wires so that electricity can be transmitted to the two circuit boards 2242. The two circuit boards 2242 are respectively installed thereon with a plurality of LEDs 2243 having their front ends respectively extending out of notches 2244 formed after combining the front and the near half arm shell 221, 222 together.

The circuit board 2233 is provided with a time series control circuit (control IC) for controlling the flickering sequence and time of the LEDs 2243, and a centrifugal starting switch for controlling starting of the time series control circuit, that is, as soon as the center arm body 223 and the side arm bodies 224 are rotated, the centrifugal starting switch, by its centrifugal force, will start the time series control circuit to control the flickering sequence and time of the LEDs 2243

The switch member 28 of the power unit 21 functions to control the electricity of the batteries. If the switch member 28 is turned off, there is no electricity for use. After the switch member 28 is turned on, the electricity of the batteries can be available, but this doesn't mean that the electric force has already been transmitted to the motor 29 and the two conducting brush members 35, 36. Only after the sound switch 24 is started, can the electricity be transmitted to the motor 29 and the two conducting brush members 35, 36.

To play with the lamp ball of this invention, firstly, the switch member 28 has to be started, but at this time the lamp ball is still motionless and gives out no light. Next, the power-and-lamp arm unit 20 is put in the interior of the spherical outer casing 10 and the integral body is placed on a flat surface. Then, clap hands or give off sounds to start the sound switch 24 to let the motor 29 and the two conducting brush members 35, 36 receive electricity and then the sounder 26 gives out music or sounds for elevating entertaining effect. Thus, the motor 29 can be started to rotate its upper and lower shaft 291, 292, and in the meantime, the lower shaft 291 will actuate the two rollers 25 to rotate and the no-power roller 23 will also be actuated to push against the inner wall of the spherical outer casing 10 and rotate, letting the whole power-and-lamp arm unit 20 produce a force for pushing the spherical outer casing 10 to roll freely. Additionally, the balance weight member 27 for balancing the center of gravity of the power-and-lamp arm unit 20 can always keep the lamp arm 22 positioned at the upper side of the power-and-the lamp arm unit 20.

The upper shaft 292 of the motor 29, through interaction, can actuate the lamp arm 22 to rotate; therefore, as soon as the centrifugal starting switch on the circuit board 2233 is started, the time series control circuit will start to control the flickering sequence and time of the LEDs 2243. Thus, by rotation of the lamp arm 22 and various flickering sequence of the LEDs 2243, the changeable light patterns or letters inside can be seen through the transparent outer casing 10, and that especially is clearly due to the effect of visual persistence.

As mentioned above, the circuit board 2242 of one side arm body 224 is positioned higher than the circuit board 2242 of the other side arm body 224. By so designing, when the two side arm bodies 224 are rotated at the same time, the two circuit boards 2242 positioned at different levels will be actuated to rotate together, forming an arc-shaped track, and the LEDs 2243 on the two circuit boards 2242 will flicker on this arc-shaped track. Thus, due to visual persistence, when people see and enjoy the lamp ball of this invention, they will be unaware that there are two different side arm bodies 224 and that the two circuit boards 2242 are positioned at different levels.

In addition, the lamp ball of this invention can be additionally provided with a time control circuit for setting and controlling time of power supply, that is, power supply is to be stopped when the time set by the time control circuit is up, and the motor 29 and the LEDs 2243 will be stopped in operating. At this time, a player has to give off sounds to start the sound switch 24 again to let the motor 29 operate and make the LEDs 2243 give out light. If the lamp ball is provided with no time control circuit and when a player would not like to play with the lamp ball any longer, the player has to pick up the spherical outer casing 10 and quickly disconnect the two half casing 11, 12, and take out the power-and-lamp arm unit 20 and turn off the switch member 28 immediately.

For the convenience of use, a remote-controlled switch can be provided to take the place of the sound switch 24 for controlling the motor 29 and the LEDs 2243 to operate. In this case, after the switch member 28 is started, the remote-controlled switch has to be started to enable the power-and-lamp arm unit 20 to function. The remote-controlled switch can also stop the operation of the power-and-lamp arm unit 20 from outside of the spherical outer casing 10; therefore, the foresaid time-control circuit is needless. The remote-controlled switch can be operated by ultra-red ray or by wireless, that is, an ultra-red ray receiver or a wireless receiver is to be provided in the power unit 21 for receiving the ultra-red rays or high frequency waves emitted by a remote-controller for starting the power unit 21 and the lamp arm 22 to operate.

If the lamp ball of this invention is provided with neither the sound switch 24 nor the remote-controlled switch, the lamp ball still can be actuated to rotate, only that a player has to quickly put the power-and-lamp arm unit 20 into the spherical outer casing 10 and combine the two half casings 11, 12 together after the switch member 28 is started and the power device 21 begins to function. On the other hand, in case no sound switch 24 or no remote-controlled switch is used, a delay starting switch can be installed on the circuit. Thus, although the switch member 28 is started, yet the power unit 21 and the lamp arm 22 cannot be started to operate until the time (5 second or 10 seconds) set by the delay starting switch is up. Therefore, within this delayed time, a player can put the power-and-lamp arm unit 20 into the spherical outer casing 10.

Figure 9:
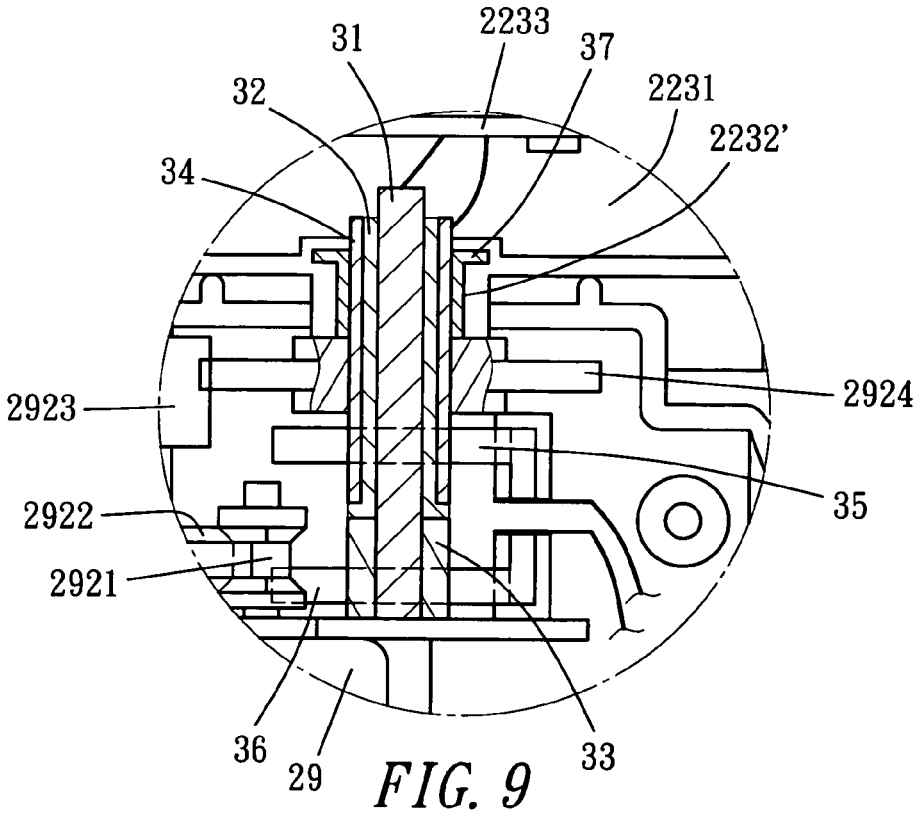
FIG. 9 is a cross-sectional view of the rear half casing of the lamp ball in the present invention, showing that certain components in FIG. 8 are altered.

Substantially, some parts of the structure mentioned above can be altered without affecting its operating effect. For example, the conducting bushing 33, as shown in FIG. 8, can be omitted and the conducting brush member 36 can be curvedly enlarged to let it always contact with the center shaft 31, and the conducting shaft tube 34, as shown in FIG. 9, can be fitted thereon with an angle bushing 37, and the hollow shaft groove 2232' of the center arm body 223 is formed into an angle portion for the angle bushing 37 to be stably fitted thereon. In addition, the circuit board 2233 and the circuit boards 2242 can be installed separately or combined together. Additionally, the circuit boards 2242 on which the LEDs 2243 are assembled can also be omitted, and the electricity of the circuit board 2232 is connected with the LEDs 2243 installed inside the arm body 24 of the lamp arm 22 by means of electric wires. The equivalent alteration mentioned above is within the scope of this invention.

Evidently, the power unit 21 provided in the lamp ball of this invention enables the spherical outer casing 10 of the lamp ball to roll and move forward freely, and the lamp arm 22 positioned inside the spherical outer casing 10 can be actuated to rotate and give off flickering lights at the same time, exclusively original and innovative in structure.

While the preferred embodiment of the invention has been described above, it will be recognized and understood that various modification may be made therein and the appended claims are intended to cover all such modifications that may fall within the spirit and scope of the invention.

I claim:

1. An automatically rotatable lamp ball comprising a power unit composed of a front half unit and a rear half unit, said power unit having its interior installed with batteries and a motor, said power unit provided with a switch member for controlling power conduction of said batteries, said motor provided with a downward shaft for driving rollers assembled at one side of said power unit to rotate after reducing speed, said power unit having the other side assembled with a no-power roller, said motor further provided with an upward shaft for driving a gear to rotate after reducing speed, said gear bored with a center shaft hole;

a lamp arm composed of a front arm shell and a rear half arm shell, said lamp arm divided into a center arm body positioned above said power unit and two side arm bodies respectively extending downward from said center arm body arcuate to two opposite sides, said center arm body of said lamp arm having its interior formed with a center chamber for receiving a circuit board, said center arm body of said lamp arm formed with a hollow shaft groove extending downward, said two side arm bodies having their interiors respectively formed with a side chamber for installing a plurality of LEDs therein, said LEDs electrically connected with said circuit board;

a transmission unit formed with a conducting center shaft, said center shaft having a part of its upper outer side fitted around with an insulating sleeve, said insulating sleeve having its outer side firmly fitted around with a conducting shaft tube, said center shaft, said insulating sleeve and said conducting shaft tube together making up a rod-shaped conductive unit, said rod-shaped conductive unit inserted through said center shaft hole of said gear of said power unit, said rod-shaped conductive unit then firmly positioned in said hollow shaft groove under said center chamber of said lamp arm, said rod-shaped conductive unit supporting said lamp arm and serving as a rotation axle of said lamp arm, a conducting brush member respectively disposed in said front and said rear half unit of said power unit, said two conducting brush members respectively having one end fixed in position and electrically connected with electricity, said two conducting brush members respectively having the other end always contacting with said conducting center shaft and said conducting shaft tube, said center shaft and said conducting shaft tube electrically connected with said circuit board in said center arm body of said lamp arm; and, said motor in said power unit driving said rollers to rotate after said switch member of said power unit is started to let said batteries supply electricity, said motor synchronously driving said lamp arm at the upper side to rotate and said LEDs in the interior to give out light.

2. The automatically rotatable lamp ball as claimed in claim 1, wherein the integral body composed of said power unit and said lamp arm and said transmission unit is put into the interior of a transparent outer casing, said transparent outer casing having its inner side pushed by said rotating rollers and driven to roll freely, the lights of said LEDs in said lamp arm able to be seen through said outer transparent outer casing.

3. The automatically rotatable lamp ball as claimed in claim 1, wherein said power unit is disposed with a sounder having music or sound preset, said sounder able to give out music or sounds for increasing entertaining effect when said rollers rotates.

4. The automatically rotatable lamp ball as claimed in claim 1, wherein said power unit is provided with a sound switch for connecting electricity so that, if necessary, a player can make sounds to start said sound switch to let the electricity conducted to said motor and said transmission unit.

5. The automatically rotatable lamp ball as claimed in claim 1, wherein a balance weight member is disposed under said power unit for balancing the center of gravity of said lamp ball and keeping said lamp arm always positioned at the upper side of said lamp ball.

6. The automatically rotatable lamp ball as claimed in claim 1, wherein said insulating sleeve is fitted around the outer side of an upper part of said center shaft, having its lower end expanding outward and forming a disc-shaped bottom rim, said center shaft having the rest part fitted around with a conducting bushing, said disc-shaped bottom rim of said insulating sleeve insulating said conducting bushing from said conducting shaft tube fitted on the outer side of said insulating sleeve, one of said two conducting brush members electrically connected with said conducting bushing, said conducting bushing then transmitting electricity to said center shaft.

7. The automatically rotatable lamp ball as claimed claim 1, wherein said conducting shaft tube of said transmission unit is fitted around with an angle bushing, and said hollow shaft groove of said center arm body of said lamp arm is formed with an angle portion for said angle bushing to be fitted therein so as to stabilize the combination.

8. The automatically rotatable lamp ball as claimed in claim 1, wherein said side chambers of said lamp arm are respectively fixed therein with a circuit board for installing LEDs therein, said circuit boards of said lamp arm electrically connected with said circuit board in said center arm body for supplying said LEDs with electricity.

9. The automatically rotatable lamp ball as claimed in claim 1 or 8, wherein said front and said rear half arm shell of said lamp arm, after combined together, are formed with a plurality of notches for said LEDs to extend out therethrough.

10. The automatically rotatable lamp ball as claimed in claim 1, wherein said circuit board in said center chamber of said lamp arm is installed with a centrifugal starting switch for controlling power connection between said circuit board and said LEDs.

11. The automatically rotatable lamp ball as claimed in claim 1, wherein said circuit board in said center chamber of said lamp arm is provided with a time series control circuit for controlling the flickering sequence and time of said LEDs.

12. The automatically rotatable lamp ball as claimed in claim 1, wherein said power unit is provided with a time control circuit for controlling time of successive power supply.

13. The automatically rotatable lamp ball as claimed in claim 1, wherein said power unit is disposed with a remote-controlled switch for remotely controlling power connection.

14. The automatically rotatable lamp ball as claimed in claim 1, wherein said LEDs in one of said side arm bodies are positioned higher than said LEDs in the other of said side arm bodies so that, when rotating, said different-leveled LED s may form an arc-shaped track for the flickering lights of said luminous bodies to follow.

15. The automatically rotatable lamp ball as claimed in claim 8, wherein said circuit board in one of said side arm bodies is positioned higher than said circuit board in the other of said side arm bodies so that, when rotating, said two circuit boards may form an arc-shaped track for the flickering lights of said LEDs installed on said two circuit boards to follow.

* * * * *